US008944972B2

(12) United States Patent
McConnell

(10) Patent No.: US 8,944,972 B2
(45) Date of Patent: Feb. 3, 2015

(54) DESCENT APPARATUS

(75) Inventor: Geofrrey Neil McConnell, Christchurch (NZ)

(73) Assignee: Archimedes Applied Limited, Christchurch (NZ)

( * ) Notice: Subject to any disclaimer, the term of this patent is extended or adjusted under 35 U.S.C. 154(b) by 269 days.

(21) Appl. No.: 13/318,473

(22) PCT Filed: May 4, 2010

(86) PCT No.: PCT/NZ2010/000086

§ 371 (c)(1),
(2), (4) Date: Dec. 8, 2011

(87) PCT Pub. No.: WO2010/143979

PCT Pub. Date: Dec. 16, 2010

(65) Prior Publication Data

US 2012/0077649 A1 Mar. 29, 2012

(30) Foreign Application Priority Data

May 4, 2009 (NZ) ..... 576697

(51) Int. Cl.

| | |
|---|---|
| ***A63B 21/00*** | (2006.01) |
| ***A63B 23/00*** | (2006.01) |
| ***A63B 21/008*** | (2006.01) |
| ***A63B 9/00*** | (2006.01) |
| ***A62B 1/20*** | (2006.01) |
| ***A63G 31/02*** | (2006.01) |
| *A63G 31/10* | (2006.01) |
| *A63G 31/00* | (2006.01) |

(52) U.S. Cl.

CPC ... *A63B 9/00* (2013.01); *A62B 1/20* (2013.01); *A63G 31/02* (2013.01); *A63G 31/10* (2013.01); *A63G 31/007* (2013.01)

USPC ..... 482/111; 482/112; 482/92; 482/148

(58) Field of Classification Search

USPC ..... 482/111, 112, 113, 110, 121–126, 92, 482/129, 20, 98, 104; 472/128, 129, 1, 2, 472/35, 36

See application file for complete search history.

(56) References Cited

U.S. PATENT DOCUMENTS

| | | | |
|---|---|---|---|
| 3,252,547 | A | 5/1966 | Hornedo |
| 4,712,652 | A | 12/1987 | Smidek |

(Continued)

FOREIGN PATENT DOCUMENTS

| | | |
|---|---|---|
| ES | 2061366 | 12/1994 |
| JP | 10-139311 | 5/1998 |

(Continued)

*Primary Examiner* — Oren Ginsberg
*Assistant Examiner* — Megan Anderson
(74) *Attorney, Agent, or Firm* — Stephen M. De Klerk

(57) ABSTRACT

A descent apparatus (1) including a housing (3) with a liquid conduit (4) therethrough and a float (8) constrained within the liquid conduit (4) and capable of slideable movement along a first path between an upper and a lower position. A moveable element (6) is located outside the liquid conduit (4) and is slideably coupled to the housing (3). A mechanical connector (9) physically connects the movable element (6) to the float (8) such that in use, the liquid conduit (4) contains liquid and the position of the float (8) is variable by applying a force to the movable element (6) and wherein the slideable movement of the float (8) along a first path produces a corresponding movement of the moveable element (6) outside the housing (3) along a second path co-axial, or parallel with the first path.

34 Claims, 4 Drawing Sheets

(56) References Cited

U.S. PATENT DOCUMENTS

| | | | | |
|---|---|---|---|---|
| 4,914,915 | A | 4/1990 | Linderfelt | |
| 5,054,319 | A | 10/1991 | Fling | |
| 5,478,312 | A * | 12/1995 | Weissbuch | 482/111 |
| 5,906,565 | A * | 5/1999 | Wasserman et al. | 482/112 |
| 6,022,301 | A * | 2/2000 | Fahlman | 482/111 |
| 6,997,251 | B2 | 2/2006 | Baird | |
| 7,298,054 | B2 * | 11/2007 | Hirsch | 290/42 |
| 2009/0253319 | A1 * | 10/2009 | Ferru | 441/79 |
| 2010/0004373 | A1 * | 1/2010 | Zhu et al. | 524/448 |
| 2010/0109329 | A1 * | 5/2010 | Brantingham | 290/53 |

FOREIGN PATENT DOCUMENTS

| | | |
|---|---|---|
| JP | 10-2010812 | 8/1998 |
| JP | 2007-313211 | 12/2007 |
| NZ | WO 2008030117 | * 12/2010 |

* cited by examiner 1a) 1b)

DESCENT APPARATUS

CROSS-REFERENCE TO OTHER APPLICATIONS

This is a National Phase of International Application No. PCT/NZ2010/000086, filed on May 4, 2010, which claims priority from New Zealand Patent Application No. 576697, filed on May 4, 2009.

TECHNICAL FIELD

The present invention relates to a descent apparatus and more particularly to a descent apparatus that descends under a force applied by a user or a weight force applied by an object.

BACKGROUND ART

There, is growing societal concern about the physical inactivity of children and the detrimental affects this may be having on their physical and mental development. Research also suggests there is an increasing rate of obesity amongst the young.

There is therefore a demand for play equipment that will engage children and in doing so encourage physical activity, increase skills, creativity and social interaction. This equipment must be safe to minimise the likelihood of serious accidents, whilst still stimulating the children physically and engaging them mentally. It is also desirable for the equipment to be robust enough to continue operating despite physical impacts and weathering.

It has been observed that interactive play equipment that incorporates moving elements is more likely to engage children and maintain that engagement for a longer period of time than static or non-interactive equipment. Equipment involving climbing inherently provides an elevated exercise dimension over comparable equipment operated at a substantially fixed level. Equipment such as slides, poles or the like, also entices the user to repetitive or cyclic climbing and descending the equipment as a natural part of play.

Thus, in many operations, including play, it is useful to lower a user from an elevated position to a lower position, e.g. as in use of a pole or slide. This may incur an inherent and uncomfortable friction experienced by the user using poles, slides or the like. Consequently, attempts have been made to reduce friction and increase comfort of slides etc with varying degrees of success.

It would thus be advantageous to provide play equipment that reduces or eliminates friction experienced by a user during descent.

The operating principles of such play equipment are of course also applied in other fields such as industry (e.g. packaging chutes), workplaces (e.g. fireman's pole) and home (lifts and slides for the disabled). Therefore, while the present invention and related art may be described herein with respect to play or exercise equipment, it should be appreciated that this disclosure is not limited to same and includes equivalent mechanisms in other applications.

The following paragraphs describe devices and systems that are of general relevance to the present invention and describe various mechanisms in the art for lowering/raising a person or object. All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

U.S. Pat. No. 3,252,547 by Homedo describes a lift or elevator which uses a lift platform positioned above and rigidly joined to a buoyant tank floating in a water reservoir. The lift lowers when the lift occupants' weight exceeds the upward buoyancy force. Homedo's disclosure is silent on how the lift rises with occupants present that weigh more than the buoyancy force, though from an engineering perspective, this may be achieved in a variety of means, e.g. the buoyancy of the tank is varied by pumping water in/out. However, the Homedo elevator is necessarily tall so as to provide space for a large enough water reservoir and tank to support the lift and occupants and to move the occupants between floors. Moreover, as the elevator shaft may be considerably tall, the water reservoir would have to extend a commensurate distance below ground level in order to lower the lift to ground level. The Homedo elevator is thus clearly expensive and unsuitable for playground use or other smaller-scale applications.

Other elevator or descent mechanisms that use buoyancy to control lift and descent are described in Japanese Patent Publication No. 10-201812 by Yasunari, U.S. Pat. No. 4,069,923 by Blumenau, PCT Publication No. WO86/02544 by Boublil and Great Britain U.S. Pat. No. 1,370,610 by Adamson. However, in contrast to the Homedo elevator, these elevators allow the elevator platform to be lowered below water level, though the platform is necessarily submerged. Thus, these devices are not useful where the user does not want to get wet.

One device that may be suitable for small-scale lift applications is described in PCT application published as WO2008/030117 by McConnell. This document describes a decorative water feature (which may be used as a lift) where a sliding platform encircles a tube within which a float is positioned in a column of water or other liquid. The float and platform are coupled together for common movement by a mutual magnetic attraction/repulsion. Thus, as the float moves, so does the platform and vice versa.

However, the McConnell magnetic water feature would require strong magnets to operate as a lift for persons and could therefore be prohibitively expensive for playground and other applications.

In many exercise machines, the working resistance is applied by external weights or by the user's own weight. The attendant problem with the user working against their own weight is that a person's strength is not always proportional to their weight; e.g. the elderly, overweight and those with a disability are likely to have a lower strength to weight ratio which may make moving their own weight unfeasible, even with force reduction mechanisms. At the opposite end of the fitness spectrum, relying solely on the user's mass for resistance has an inherent upper limit which may be insufficiently high for individuals with a high power to weight ratio. It would therefore be advantageous to provide a robust and safe recreational exercise apparatus and/or lift/elevator.

It is an object of the present invention to address the foregoing problems or at least to provide the public with a useful choice.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

SUMMARY OF THE INVENTION

According to one aspect of the present invention there is provided a descent apparatus including

- a housing with a liquid conduit therethrough;
- at least one buoyancy float constrained within said liquid conduit and capable of slideable movement along a first path between an upper and lower position;
- at least one moveable element located outside said liquid conduit and slideably coupled to said housing; and
- a mechanical connector, physically connecting said movable element to said buoyancy float
- such that in use, the liquid conduit contains liquid and the position of the buoyancy float is variable by applying a force to at least one said movable element, and
- wherein the slideable movement of said buoyancy float along said first path produces a corresponding movement of the moveable element outside the housing along a second path co-axial, or parallel with said first path.

Preferably, at said upper position, the float is either floating on the surface of the liquid or is at least partially submerged in the liquid and prevented from upwards movement by an upper stop.

The invention shall henceforth be described with respect to an embodiment where said liquid is water, though it will be readily appreciated that myriad alternative liquids may be used as desired such as oil, hydraulic fluid, and so forth.

In one preferred embodiment, the liquid is a mixture of water and a non-toxic additive such as antifreeze, e.g. propylene glycol. In another embodiment, an additive may be added for increasing viscosity.

It should be appreciated that although reference is made herein to the float, movable element and other components being in the singular, such reference should also be treated as encompassing the plural.

As used herein, reference to "physically connected" should be understood to include any connection not requiring an electrical or magnetic coupling to function successfully, even though such electrical or magnetic couplings may also be present.

As used herein, the term "inhibited" should be understood to refer to a partial restraint or prevention and should not be interpreted to refer to complete 'prevention'.

Preferably, in use, said float is submerged in liquid throughout the range of said slideable movement along said first path.

Preferably, said slideable movement has an at least partially vertical component. According to one embodiment, said slideable movement may be substantial linear about a vertical axis. However, it will be readily appreciated that alternative housing and liquid conduit configurations are possible in which movement of the float may be constrained to include a circuitous, or a partially lateral component as well as the vertical component.

Preferably, said movable element includes a platform or the like for supporting a person and/or other object during said slideable movement. Thus, the movable element may bear the weight of the person and/or object and will slide downwards relative to the housing if the total mass of the person and/or object, movable element, mechanical connector and float is greater than the buoyancy force acting on the float. In a playground application, such a descent apparatus may be used as a novel pole or slide alternative, e.g. a person may climb to a height and move onto the movable element, the movable element descending under the person's weight until reaching the ground or a lower position. When the person moves off the movable element, it will rise to its original position under action of the buoyancy force.

Preferably the movable element is also rotatable relative to said housing. A rotatable moveable element provides another dimension of movement possible to enhance the entertainment value and/or functionality of the apparatus.

Preferably, the liquid conduit and/or housing includes an upper stop for inhibiting upwards movement of said float and/or movable element. The upper stop may thus act to maintain the float and movable element in a 'ready' position prior to sufficient weight, e.g. a person, being applied to the movable element.

It will be appreciated that in some applications, e.g. a playground, the movable element may be at some height above the ground and persons may find it difficult or frightening to stand on the movable element if it is freely rotatable. Thus, in one preferred embodiment, rotation of the float and/or movable element relative to the liquid conduit is at least partially inhibited through at least a portion of the range of said slideable movement.

More preferably, said portion of inhibited rotation is located at an upper extent of said slideable movement. It will be appreciated that numerous methods and mechanisms may be used to prevent rotation of the float and/or movable element and by way of example may include; a catch, lock or the like operable to engage with both the float/movable element and a portion of said housing and/or liquid conduit. In an alternative embodiment, a part of the float and/or movable element may be mutually engageable with corresponding portions of the housing and/or liquid conduit at an, upper extent of said slideable movement such that said slideable movement is possible but relative rotation is prevented. Such mutual engagement may be achieved for example by providing a vertically extending rib(s) on the float which is engageable with a slot(s) in the upper extent of the liquid conduit.

In preferred embodiments however, rotation of said movable element at said upper extent is inhibited by frictional contact between:

- a portion of said float and/or said mechanical connector, and
- said upper stop.

The frictional contact is governed by the buoyancy force urging the float and/or mechanical connector portion into contact against the upper stop and also the surface structures of the float and/or mechanical connector portion contacting the upper stop. Such a frictional mechanism for preventing rotation is simple and ensures that rotation is only prevented at the uppermost extent of slideable movement.

Preferably, rotation of the movable element relative to said housing is inhibited through a lower portion of said slideable movement. Preferably, rotation of said movable element through said lower portion is inhibited by frictional contact between:

- a portion of said float and/or said mechanical connector and
- said upper stop.

In another embodiment, a lower stop may be provided to inhibit rotation of said movable element through said lower portion, said rotation being inhibited by frictional contact between:

a portion of said float and/or said mechanical connector and said lower stop.

Preferably, a buffer portion of said mechanical connector is engageable with said upper stop near the lower extent of said movable element slideable movement. Preferably, said buffer portion is constructed from an elastomeric material or similar. Such a buffer portion reduces the shock otherwise experienced by the user of the movable element stopping at the lower extent of slideable movement.

Preferably, engagement of said buffer portion with said upper stop inhibits relative rotation of the movable element and upper stop. Thus, as rotation is inhibited when the movable element is at its lowermost position, persons may not use the movable element as a carousel or the like and thereby frustrate those awaiting a turn. Preferably said engagement of said buffer portion and upper stop is a frictional contact.

Preferably, said mechanical connector is configured such that said movable element and float may be maintained in a fixed spatial relationship with respect to each other to travel along respective first and second paths. Thus, as the movable element slides and or rotates relative to said housing, so does the float.

In an alternative embodiment, the float may be configured to move with said slideable movement of the movable element but not rotate with the mechanical connector and/or movable element.

Preferably, the movable element may be directly physically connected to the float. By way of example, the movable element may be formed as a continuous member(s) with a mechanical connector portion extending into said liquid conduit to said float.

In another preferred embodiment, the movable element may be physically connected to the float via one or more intermediate rigid members connected to the float, said slideable movement of said movable element producing a corresponding movement in the rigid member and float.

In an alternative embodiment, the movable element may be physically connected to the float via a flexible member, e.g. a cable and pulley system, chain, belt or the like.

Preferably, a said rigid member includes a duct in liquid communication with said liquid conduit. The duct can thus receive displaced liquid from the liquid conduit during float movement and may also be used to pass liquid into the liquid conduit ready for use or replenish liquid that has egressed from the liquid conduit, e.g. under evaporation. Preferably, the liquid duct is also open to atmosphere.

Preferably, said rigid member includes a superhydrophobic surface. It should also be appreciated that any other components may also include superhydrophobic surfaces. The superhydrophobic surface may be formed by covering with a resin, paint, laminate or sleeve or the surface may be constructed from a superhydrophobic material.

According to another aspect of the present invention said housing includes an elongate tube with an inner and an outer surface. In one embodiment the or each slideable movable element is located about said outer surface with said float located adjacent said inner surface.

Preferably, said tube is orientated substantially vertical.

Preferably, the inner tubular surface also defines said liquid conduit. Liquid present in the liquid conduit thus acts to urge the float therein vertically upwards.

Preferably in use the liquid conduit is open to atmosphere.

In an alternative embodiment, said liquid conduit is substantially sealed to inhibit liquid egression.

Preferably, said movable element encircles said housing.

Preferably, said movable element includes an annular platform encircling said housing outer surface. The annular platform may support an object or person and will slide downwards relative to said housing if the combined weight of the float, person/object, platform and the platform's mechanical connector to the float is greater than the buoyancy force of the float in the liquid.

Preferably, the housing outer surface is substantially continuous such that there are no encumbrances to said movable element slideable movement. More preferably, the housing outer surface is free from protrusions or the like that could create a potential 'shearing point', 'entrapment hazard', or 'crushing point' between the movable element and housing outer surface, The movement of the float within the liquid conduit is governed by factors including:

the float's buoyancy (a function of its mass and volume) with respect to the liquid density and viscosity, the vertical height, the upward thrust, and the surface area and configuration of the lower float surface presented to the thrust, of any liquid present within the conduit, together with interaction with any physical constraints from the liquid conduit, e.g. friction or engagement with any barriers or stops.

Preferably, said float is formed from a hollow tank, capsule or the like. Alternatively, the float may be formed from low density air-encapsulating material, such as polystyrene.

In one embodiment, the buoyancy of the float may be varied, e.g. by injection or extraction of gas and/or liquid into the float. Providing a variable buoyancy float allows the ascent/descent characteristics of the descent device to be varied to suit different applications, e.g. the descent acceleration may be increased (for a given weight on the movable element) by extracting gas and adding liquid to the float, thereby reducing the buoyancy of the float.

Preferably, the liquid conduit includes at least one liquid displacement passage permitting passage of liquid displaced from beneath or above said float as a result of float descent or ascent respectively. The float is thus submergible in the liquid in the liquid conduit. It will be appreciated that without such a liquid displacement passage, the movement of the float in the liquid conduit will compress the liquid, increasing liquid pressure and preventing further movement of the float.

The liquid displacement passage may be provided in a number of forms including providing one or more of:

a said liquid conduit larger in transverse cross-section than the float, said liquid displacement passage thus formed between the float and the liquid conduit;

said float with an internal aperture or the like passing therethrough, said aperture forming said liquid displacement passage;

a further liquid conduit(s) outside the confines of said liquid conduit, e.g. external piping, the further liquid conduit(s) thus forming the liquid displacement passage.

Preferably, the total cross-sectional area (transverse to liquid flow during said displacement) of the liquid displacement passage is smaller than the cross-sectional area (transverse to float movement in said liquid conduit) of the float thus effectively providing a constriction to liquid flow. The pressure of the liquid in the liquid conduit during float movement thus increases with the speed of float movement as the volume of liquid displaced increases. This dynamic increase in pressure thus resists the movement of the float in said liquid conduit and limits the speed of float movement and therefore also movable element movement.

The utilisation of dynamic pressure to control the speed of float and movable element movement provides significant advantages over the devices referred to in the background art section above. For example, the size requirement of the float and liquid conduit is reduced relative to these other devices which require a more buoyant or larger float to provide a comparable reduction in speed. Moreover, the dynamic pressure increases with speed (and thus volume displaced) and can be used to control speed far more effectively than relying on buoyancy force alone.

According to a further aspect of the present invention, the vertical height of the float and moveable element connected to the float is controlled by adjusting the vertical height of a column of liquid in the liquid conduit.

It may be advantageous for the movable element to also rotate during the slideable movement as this may provide an enhanced entertainment value for the user. Thus, in one embodiment, the float includes one or more fins configured to cause rotation of the float during said slideable movement.

In another embodiment, the liquid conduit and float may have complimentary engaging projections configured to cause rotation of the float during said slideable movement. Preferably, said complimentary engaging projections include a helical flange and one or more locating guides.

Preferably, said liquid apparatus further includes a liquid supply, pump and liquid flow control system. The liquid flow control system may be comprised of a variety of known means capable of regulating and/or varying the liquid flow rate, and may be formed integrally with the pump, or as a discrete unit interfaced with the pump, or operate as a standalone unit. The present invention may also incorporate numerous features of the magnetic water feature described in WO2008/030117 including, but not limited to,

- magnetic buffers replacing, or supplementing the upper and lower stops. By appropriate use of a repelling polarity magnet, magnetic buffers may provide a cushioned deceleration of the moveable element at the limits of its allowable vertical travel;
- supplementary, or alternative motive means to raise and lower the moveable elements (acting on the float, moveable element or both), including electromagnetic induction, pulleys, electrical, hydraulic, pneumatic and other mechanical and electromechanical drives. Although such drive means may add complication, and potential unsightliness, the mechanisms may be concealed within the housing leaving the moveable elements visually free of any apparent drive means.
- the housing, float and/or the moveable element may be formed as translucent, transparent or opaque to give differing visual effects. Moreover, non-opaque construction enables the incorporation of internal lighting in addition to external lighting for yet further visual enhancements.
- the descent apparatus may be configured to allow liquid from the liquid conduit to egress from the housing onto the movable element.
- The moveable element may include liquid drain apertures, positioned to allow the egress of liquid collected thereon. In one embodiment, the drain apertures are reversibly sealable. Thus, the drain apertures may be unsealed or 'opened' by some form of trigger, either remotely (e.g. electronically controlled valves) or automatically e.g. by contact of the element with the upper stop. In embodiments with fixed, unsealed drain apertures, when the moveable element is in an upper position (e.g. resting against the upper stop), the moveable element vertical position may be lowered by a liquid flow controller setting a flow rate sufficient to cause the ingress of liquid into a liquid detention portion of the movable element (either received as overflow from the housing liquid conduit or from an external liquid supply controlled by the liquid flow controller) to exceed the drainage rate from the drain apertures.

The present described invention may provide a safe and robust descent apparatus for persons or objects to descend from an elevation to a lower position without requiring submerging of the person/object, nor requiring a large liquid reservoir.

According to another aspect of the present invention there is provided an exercise apparatus including a descent apparatus as aforementioned, wherein said movable element includes a user-engagement element (herein referred to as a 'user handle') configured such that a user can apply a force to said user handle to move the movable element along said first path.

Preferably said user handle is a handle, bar, brace, stirrup, pad, plate, coupling, fitting or the like allowing a user to hold, push or pull the user handle to apply a force to the movable element against the buoyancy force applied by the float. It will be appreciated that the user handle is not restricted to manual use by the users hand, but may be configured to be operable by any appropriate portion of the user's body (e.g. feet, legs, torso, etc) capable of applying the necessary force.

In another embodiment the user handle may include a cable and pulley system connected to a handle.

It will be appreciated that numerous conventional exercise mechanisms may be connected to the movable element and operable to apply a force against the buoyancy force and the examples herein should not be seen to be limiting.

Preferably, the liquid conduit of the exercise apparatus includes at least one liquid displacement passage permitting passage of liquid displaced from beneath or above said float as a result of float descent or ascent respectively.

The liquid displacement passage may be provided in a number of forms including one or more of:

- a said liquid conduit larger in transverse cross-section than the float, said liquid displacement passage thus formed between the float and the liquid conduit;
- said float including an internal aperture or the like passing therethrough, said aperture forming said liquid displacement passage;
- a further liquid conduit(s) outside the confines of said liquid conduit, e.g. external piping, the further liquid conduit(s) thus forming the liquid displacement passage.

Preferably, the total cross-sectional area (transverse to liquid flow during movement of the float through the liquid) of the liquid displacement passage is smaller than the cross-sectional area (transverse to float movement in said liquid conduit) of the float thus effectively providing a constriction to liquid flow. The pressure of the liquid in the liquid conduit during float movement thus increases with the speed of float movement as the volume of liquid displaced increases. This dynamic increase in pressure thus resists the movement of the float in said liquid conduit and limits the speed of float movement and therefore also movable element movement.

In many exercise machines, the resistance is applied by external weights or by the user's own weight. The attendant problem with the user working against their own weight is that a person's strength is not always proportional to their weight; e.g. the elderly, overweight, those with a disability and highly fit/strong individuals are likely to have a strength to weight ratio which may make the range of resistance produced by moving their own weight insufficient, even with force reduction or multiplication mechanisms.

The exercise apparatus as aforementioned provides an alternative resistance mechanism that utilises dynamic pressure to control the speed of float and provide a dynamic resistance force that increases with speed and can therefore be used to offer a speed-dependant resistance force for the user. The exercise apparatus may thus be used by a range of users of differing strengths who can choose the level of resistance by altering the speed of movement.

BRIEF DESCRIPTION OF DRAWINGS

Further aspects of the present invention will become apparent from the following description which is given by way of example only and with reference to the accompanying drawings in which.

DETAILED DESCRIPTION OF THE INVENTION

Figure 1:
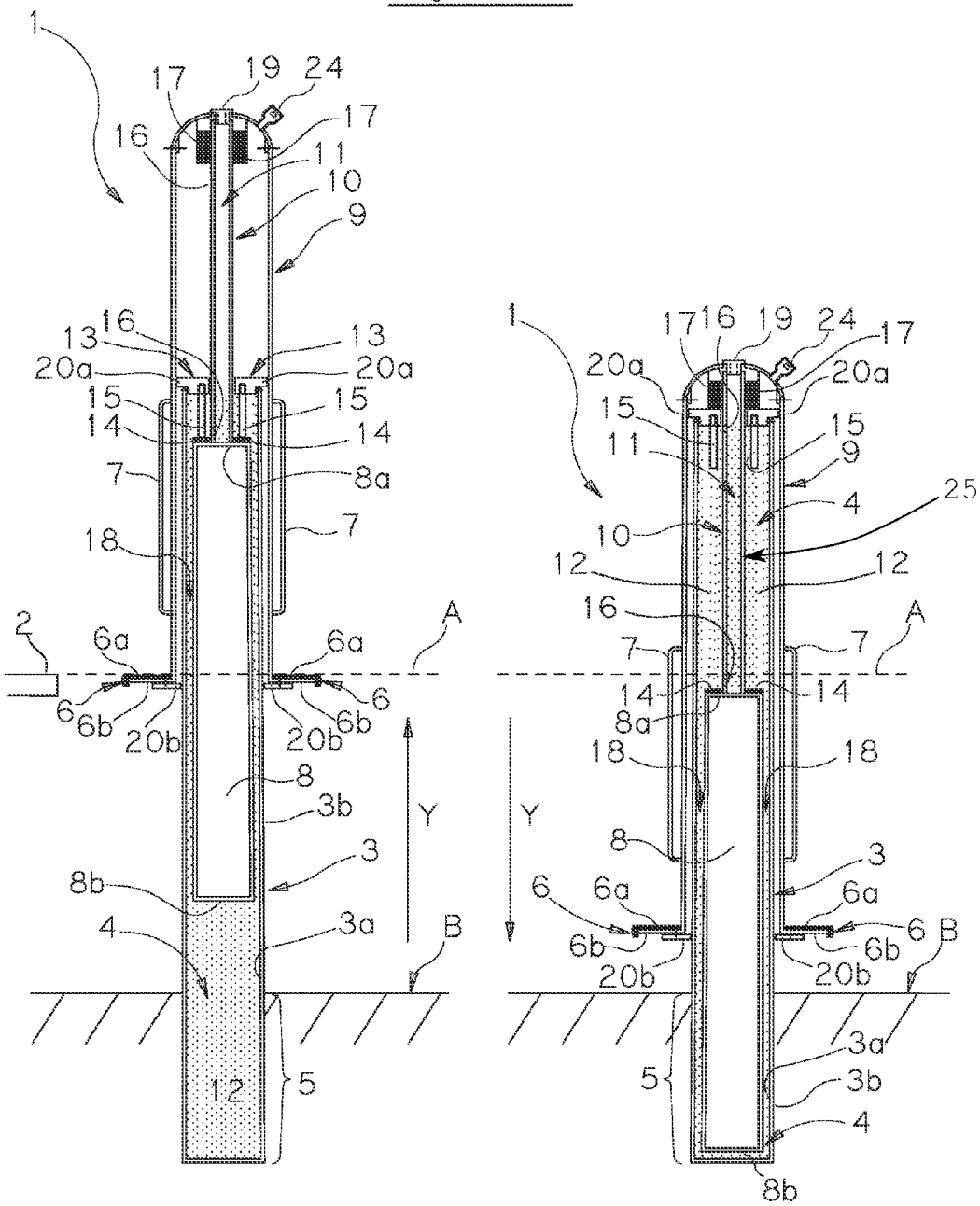
FIG. 1*a* shows a side elevation of a vertical cross-section through a descent apparatus according to one preferred embodiment of the present invention.
FIG. 1*b* shows a side elevation of a vertical cross-section through the descent apparatus of FIG. 1*a* with a movable element in a descended position.

FIG. 1 shows one preferred embodiment of the present invention of a descent apparatus (1) for providing controlled descent from an elevation (indicated by line (A)). By way of example, the elevation (A) may be at an elevated (from ground) part (2) of a ladder, playground structure, tree, or upper floor of a building.

The descent apparatus (1) comprises of a housing (3) formed from a substantially vertical elongate tube with an inner (3*a*) and an outer (3*b*) surface. The inner tubular surface (3*a*) also defines a liquid conduit (4) extending through the housing (3). The housing (3) is located in the ground with a foundation portion (5) below ground for supporting the descent apparatus (1) in an upright position. It will be appreciated that the foundation portion (5) in the ground may be embedded in concrete or locked into a purpose-made sheath which would allow convenient removal when required for maintenance, removal or replacement.

A hollow, air-filled tank (8) is located in the liquid conduit (4) and forms a buoyancy float (8) that floats in liquid (12) in the liquid conduit (4) and travels along a first path between an upper position (shown in FIG. 1*a*) and a lower position (shown in FIG. 1*b*). The float/tank (8) has upper (8*a*) and lower (8*b*) ends.

A moveable element is provided in the form of an annular platform (6) that is located outside the liquid conduit (4) and encircles the housing outer surface (3*b*). The platform (6) is thus slideably connected to the housing (3) to move along a second path vertically from the elevation (2) (see FIG. 1*a*) to a height where the user can safely step off onto ground level (see FIG. 1*b*) indicated by line (B). As the float (8) and platform (6) are physically connected, this second path is parallel to the first path of float movement. The platform (6) is also rotatable about the housing (3) to provide another dimension of movement. The platform (6) has a rubber upper (6*a*) over an aluminium base (6*b*), the rubber upper (6*a*) provides grip for a user standing on the platform (6) to prevent slipping.

The housing outer surface (3*b*) is substantially smooth and continuous to ensure there is no possible 'shearing point', 'entrapment hazard', or 'crushing point' between the housing outer surface (3*b*) and the platform (6).

The float (8) is physically connected coupled to the platform (6) by a mechanical connector provided in the form of a sliding cap (9) formed integrally with the platform (6) at the cap's lower end. The mechanical connector also includes a rigid member provided in the form of a connector tube (10) that extends from the cap (9) to the float (8) and is fixed at either end to same. The connector tube (10) is releasably fixed to the cap (9) to allow removal, disassembly and/or maintenance. The connector tube (10) includes a duct (11) inside in liquid communication with the liquid conduit (4) via apertures (16) in the wall of the upper and lower portions of the connector tube (10). The duct (11) can thus receive displaced liquid from the liquid conduit (4) during float movement (see FIG. 1*b*) and may also be used to pass liquid into the liquid conduit (4) ready for use or replenish liquid that has evaporated. The cap (9) also includes three handles (7) (only two shown) for the user to hold onto when descending. The handles (7) are sufficiently tall to accommodate a range of user heights, e.g. smaller children may grip the bottom of the handles (7) while larger children and adults may grip the upper portions.

Low-friction bearings are also provided between the housing outer surface (3*b*) and the platform (6) and cap (9) to ensure smooth slideable movement of the cap (9) and platform (6) relative to the housing (3). There are two annular low-friction bearings (20) including upper (20*a*) and lower (20*b*) bearings. The upper bearing (20*a*) forms part of the upper stop (13) and has a low-friction outer circumference that abuts the inner surface of the cap (9) during the sliding movement (Y). The lower bearing (20*b*) is fixed to the underside of the platform (6) and has a low-friction inner circumference that abuts the outer surface (3*b*) of the housing (3) during the sliding movement (Y). The bearings (20*a*, 20*b*) thus ensure the cap (9) and platform (6) are able to smoothly slide along a second path substantially coaxially and parallel with the first path travelled by the float (8).

The bearings (20*a*, 20*b*) also inhibit transverse movement of the cap (9) and platform (6) and thus inhibit 'wobbling' of the platform (6) which may prove unsafe for users or could damage the device (1). It should be appreciated that the bearings (20*a*, 20*b*) could respectively be formed integrally with the upper stop (13) and/or platform (6) or alternatively could be provided as separate components The cap (9) is integrally formed with the platform (6) and thus the platform (6) is rigidly physically connected to the float (8) such that the platform (6) is maintained in a fixed spatial relationship with respect to the float (8). Therefore, any sliding or rotating movement of the platform (6) relative to the housing (3) produces a corresponding movement of the float (8) within the housing (3) and vice versa.

In use, the liquid conduit (4) contains liquid (12) and the position of the buoyancy float (8) is variable by adjusting the total mass of the platform (6), e.g. by a person standing on the platform (6).

Throughout the range of platform (6) slideable movement (indicated by arrows (Y)) the platform (6) is below the upper level of liquid (12). The float (8) is submerged in liquid (12) throughout the range of slideable movement so that the float (8) displaces the maximum amount of liquid (12) and therefore experiences the maximum buoyancy force possible.

A user may thus use the descent apparatus (1) to descend from the elevation (A) to the ground (B) by standing on the platform (6) which will then slide downwards along the housing (3) if the combined mass of the person, platform (6), cap (9) and float (8) is greater than the buoyancy force acting on the float (8). When the person moves off the platform (6), the platform (6) will rise to the elevation (A) under action of the buoyancy force ready for re-use. In a playground application, the descent apparatus (1) can thereby be used as a novel pole or slide alternative with children climbing to the elevation (A) and then descending using the descent apparatus (1).

It will be appreciated that a heavier person or object will result in a faster descent as the force differential between the upwards buoyancy force and the weight force due to gravity is greater. As the speed of descent is thus proportional to weight, the descent apparatus can be used safely and enjoyably by a range of different sized people, e.g. smaller children will descend at a slower and safer rate while larger children and adults descend more quickly and have a more exciting experience.

The housing (3) has an upper stop (13) which engages with an annular elastomeric dampener pad (14) on the upper end (8*a*) of the float (8) to arrest upwards movement of the float (8) and platform (6) to maintain the float and coupled movable element in a 'ready' position prior to sufficient weight, e.g. a person, being applied to the platform (6). The upper stop (13) has a spacer (15) extending downward into the liquid conduit (4) which maintains the float (8) below the upper surface of the liquid (12) in the upper position shown in FIG. 1*a*. The spacer (15) is open about part of its circumference or has apertures to allow liquid to pass through.

In a playground application children may find it difficult or frightening to move from the elevated structure (2) onto the platform (6) if the platform (6) is freely rotatable. This problem is resolved by using the frictional contact between the dampener pad (14) and upper stop spacer (15) to inhibit rotation of the platform (6) at the uppermost extent of the slideable movement—see FIG. 1*a*. The magnitude of this frictional contact is governed by the buoyancy force urging the float (8) and dampener pad (14) upwards into contact against the upper stop spacer (15) and also the surface structures of the contacting portions of the dampener pad (14) and upper stop spacer (15). Thus, the platform (6) will not rotate until the user has put sufficient weight onto the platform (6) to start the descent. However, once descended sufficiently the platform (6) is free to rotate to provide another aspect of movement and therefore a more dynamic entertainment experience.

Buffer portions provided in the form of an elastomeric dampening bush (17) are located at the top of the interior of cap (9) and engage with the upper stop (13) near the lower extent of the platform's (6) slideable movement—see FIG. 1*b*. The upper stop (13) thus also forms a 'lower' stop for halting downwards movement of the float (8) and therefore the platform (6). The dampening bush (17) reduces the shock otherwise experienced by the user when the platform (6) stops at the lower extent of slideable movement. The frictional contact between the dampening bush (17) with the upper stop (15) also inhibits rotation of the platform and thus discourages use of the platform as a carousel or the like when at the lower position which would otherwise frustrate other children awaiting a turn to descend.

The sizes of the float (8) and descent apparatus (1) are configured to suit the particular application, e.g. in a playground application the float size and buoyancy is set such that a child weighing at least 14.5 Kg is required to exceed the buoyancy force and cause the float (8) and platform (6) to descend. The float size may be scaled up to suit heavier persons or objects. While many liquids can be used to suit the particular application, in playground applications the liquid used is typically a mixture of water and a non-toxic anti-freeze such as propylene glycol which inhibits freezing of the liquid (12) which could damage the descent apparatus (1), or at least render it non-functional.

The movement of the float (8) within the liquid conduit (4) is governed by the float's (8) buoyancy which is a function of its mass and volume in the liquid (12) with respect to the liquid (12) density and viscosity, together with interaction with any physical constraints from the liquid conduit (4), e.g. friction or engagement with any barriers or stops.

The liquid conduit (4) is larger in transverse cross-section than the float (8) and the space between the housing inner surface (3*a*) and the sides of the float (8) forms a liquid displacement passage (18) permitting passage of liquid (12) displaced from beneath or above the float (8) as a result of float descent or ascent respectively. The float (8) is thus submergible in the liquid (12). The cross-sectional area of the liquid displacement passage (18) is equal to the transverse cross-sectional area of the liquid conduit (4) minus that of the float (8). As the cross-sectional area of the liquid displacement passage (18) is smaller than the cross-sectional area of the float (8), the liquid displacement passage (18) thus provides an effective 'constriction' to liquid displaced by the float (8). The pressure of the liquid (12) in the liquid displacement passage (18) during float movement thus increases with the speed of float movement as the volume of liquid displaced increases. The liquid flow thus opposes the direction of float movement and the dynamic pressure between the float (8) and housing inner surface (3*a*) thus resists the movement of the float (8) and limits the speed of float movement and therefore also the platform (6). The utilisation of dynamic pressure to control the speed of the float reduces the size requirement of the float (8) and can be used to control speed far more effectively than relying on buoyancy force alone.

The liquid conduit (4) can be filled with liquid (12) by moving the platform (6) to the lowered position shown in FIG. 1*b* and then removing a plug (19) in the connector tube (10) and then filling the liquid conduit (4) with liquid (12). The liquid (12) may evaporate over time and the float (8) and platform (6) will drop with the lower liquid level. Playground maintenance staff may monitor the liquid levels and use this filling method as part of a regular monitoring and maintenance program to ensure the liquid is at a sufficient level for operation.

It will be appreciated that the cap (9) when descending will expel the air collected between the cap (9) and housing (3). This air movement can be used to improve the entertainment value of the descent device (1) by providing a wind instrument (24) such as a whistle, flute, horn, pipe or the like in a portion of the cap (9). Thus, when a user steps onto the platform (6) and descends, air is forced through the wind instrument thus creating a noise. It will be appreciated that the instrument could also be user-adjustable.

The instrument could be provided in numerous positions on the cap (9) as long as an opening of the instrument is in fluid communication with the space between the cap (9) and housing (3).

The descent apparatus (1) shown in FIG. 1 is constructed from robust and durable materials with the housing (3), float (8) and connecting tube (10) constructed from stainless steel or similar such that the components in contact with the liquid (12) are not vulnerable to corrosion and therefore leaking of liquid. The platform (6) and cap (9) are constructed from lighter aluminium or similar and fixed to the connecting tube (10). Furthermore, the descent apparatus (1) does not require any seals, rotating or pivoting joints, cables, pulleys, springs or similar components which could fail and become dangerous or render the apparatus non-functional.

Alternatively, the apparatus components could include components constructed from plastics, carbon fibre, wood, copper or any other suitable materials.

The liquid (12) in the liquid conduit (4) may adhere to the connector tube (10) when immersed (see FIG. 1*b*) and may then evaporate when the connector tube (10) rises out of the liquid conduit (4). It is detrimental for the liquid (12) to be lost from the liquid conduit (4) as the liquid conduit (4) will then require refilling. Thus, to minimise possibility of liquid loss in this manner, the connector tube (10) is provided with a coating of superhydrophobic material (25) to prevent liquid (12) in the liquid conduit (4) from adhering to the connector tube (10) as it rises out of the liquid conduit (4) after being immersed.

Many types of superhydrophobic coatings and materials are known and by way of example only, may include the superhydrophobic materials described in U.S. Pat. No. 7,485,343, 6,793,821 or the coatings produced by NTT Advanced Technology Corporation and known as a High (water) Repellent Coating (HIREC). It should be appreciated that the inner surface (i.e. forming duct (11) of the connector tube (10) may also be provided with a superhydrophobic surface.

It should also be appreciated that any of the other components of the descent device (1) may be provided with a superhydrophobic surface to inhibit corrosion and/or water/liquid adhesion. The apparatus (1) and components may also be constructed in accordance with international standards for playground equipment such as the American Society for Testing and Materials standards ASTM 1487 and European standard for playground safety—EN 1176.

The descent apparatus (1) may thus be used as a safe and robust descent apparatus for children, other people or objects to descend from an elevation to a lower position without requiring submerging of the person/object, nor requiring a large liquid reservoir.

Figure 2:
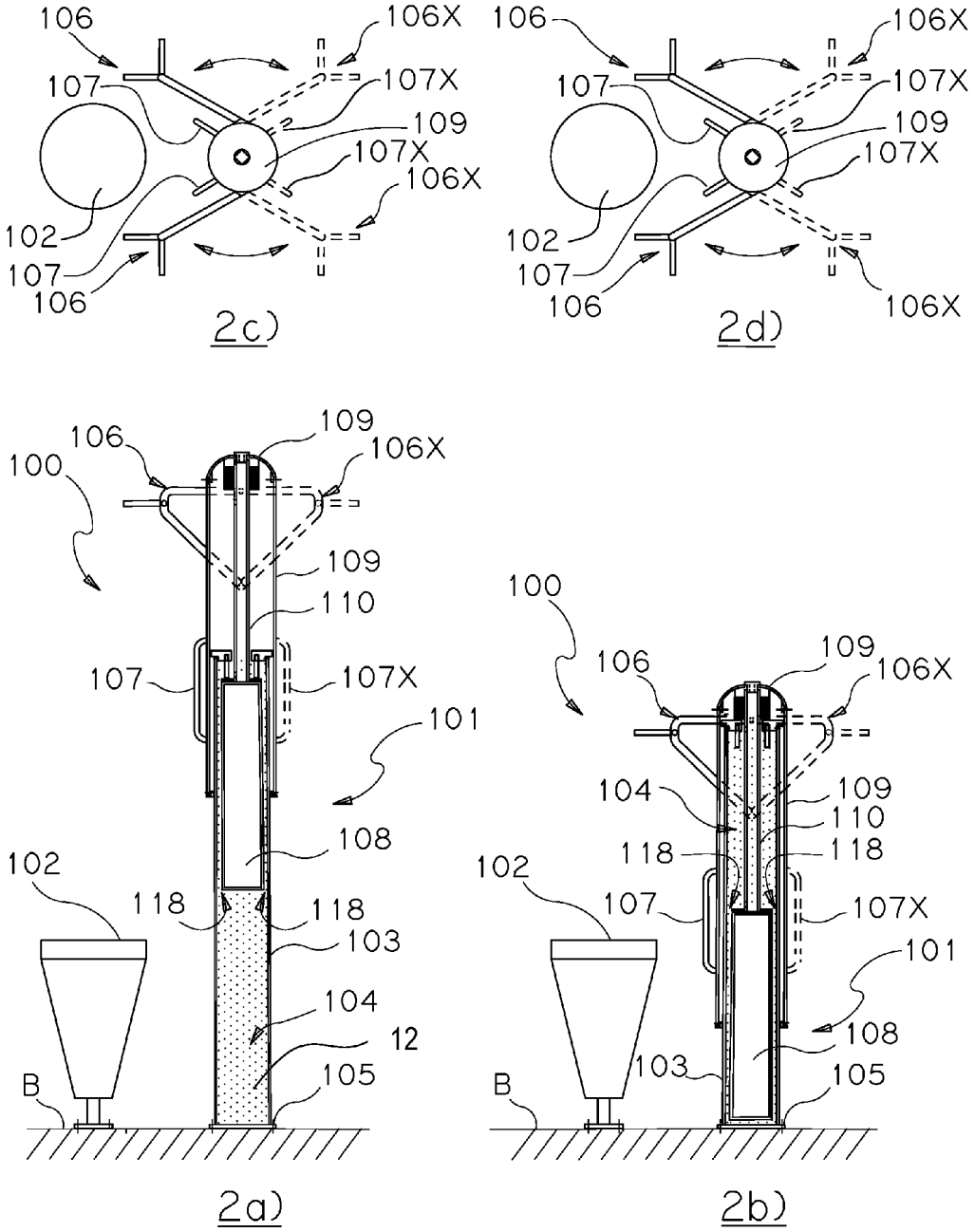
FIG. 2*a* shows a side elevation of a vertical cross-section through an exercise apparatus according to another preferred embodiment of the present invention.
FIG. 2*b* shows a side elevation of a vertical cross-section through the exercise apparatus of FIG. 2*a* with a movable element in a descended position.
FIG. 2*c* shows a plan elevation of the exercise apparatus of FIG. 2*a;*
FIG. 2*d* shows a plan elevation of the exercise apparatus of FIG. 2*b;*

FIG. 2 shows an exercise apparatus (100) according to another preferred embodiment of the present invention. The exercise apparatus (100) includes a descent apparatus (101) generally similar in function to the descent apparatus (1) of FIG. 1 and will thus be described only with reference to the differences to the descent apparatus (1).

As with the descent apparatus (1) of FIG. 1, the descent apparatus (101) includes a housing (103), liquid conduit (104) and buoyancy float (108) which operate analogously to the housing (3), liquid conduit (4) and buoyancy float (8) of FIG. 1.

The descent apparatus shown in FIG. 2 has a moveable element with an alternative configuration to that shown in FIG. 1. The movable element of the exercise apparatus (100) is configured with a user engagement element in the form of a user-handle (106) slideably connected to the housing (103) and rotatable about a vertical axis of the housing (103), as indicated by the two positions (106, 106').

The housing (103) is located on top of a work surface, e.g. a gym floor (B), with a base portion (105) bolted to the floor (B) for supporting the descent apparatus (101) in an upright position.

As with the descent apparatus of FIG. 1, the float (108) is physically connected to the movable element (handle set (106)) by a mechanical connector with a sliding cap (109) and connector tube (110).

The cap (109) also includes two lower handles (107) (only one is visible in FIGS. 2*a, b*) for the user to lower the user-handle (106) into reach or for use as the operable handles for exercise. Such lower user-handles (107) are useful for users in wheelchairs or users that are otherwise unable to reach the upper user handle set (106).

A seat (102) is provided on one side of the descent apparatus (101) for a user to sit on while exercising. The user-handle set (106, 107) can be rotated to position (106*x*, 107*x*) for use by a user in a wheelchair or the like, or who otherwise does not wish to use the seat (102).

To exercise using the exercise apparatus (100), the user grips one or two of the upper or lower user-handles (106 or 107) and pulls the handle (106 or 107) downward along the first path against the buoyancy force of the float (108).

As with the float (8) of FIG. 1, the float (108) of the descent apparatus (101) moves in the liquid conduit (104) and displaces liquid (12) through displacement passage (118) which results in a dynamic resistance applied against the movement of the float (108) that is proportional to the float's (108) velocity.

The exercise apparatus (100) thus provides a variable level of resistance independent of the user's weight or external weights but rather the speed of movement and buoyancy force, thereby accommodating users with a range of differing strengths or abilities.

The total resistance force is a combination of the buoyancy force of the float (108) in the liquid (12) and the resistance force as a result of float movement. Therefore when the user stops movement and the float (108) moves to the upper position (shown in FIG. 2*a*), the force the user must apply to control the ascent is less than the force during descent.

The exercise apparatus (100) may thus provide a high level of resistance in one direction of movement and a much lower level of resistance in the reverse. The exercise apparatus (100) may thus provide similar functionality, e.g. to air resistance rowing machines, without numerous moving parts, bearings and cables.

The above-described configuration also provides a further safety-related usability enhancement in comparison to using conventional weight-training equipment. If the user is too fatigued to continue exercising or inadvertently loses control of conventional weight training equipment midway through a repetition, there is a risk of injury and/or equipment damage as the released weights fall back to their rest position. In contrast, releasing the user-handles (106) of the present invention at any point simply causes the float (108) to rise gently to its upper position.

It will be appreciated that the level of resistance can also be varied by altering the buoyancy of the float (108), e.g. by partly filling the float (108) with liquid or adding weight to the float.

It will be appreciated that numerous conventional exercise mechanisms may be connected to the user-handle set (106, 107) or replace the handle set (106, 107) and thus the example given herein should not be seen to be limiting. For example, in a further embodiment (not shown), a cable and pulley arrangement may be used to reverse the resistance direction of the exercise apparatus (100), i.e. pulleys may be fixed to the base (105) and a cable run from the handle set (106, 107) through the pulleys to a handle which the user can then pull upwards.

Figure 3:
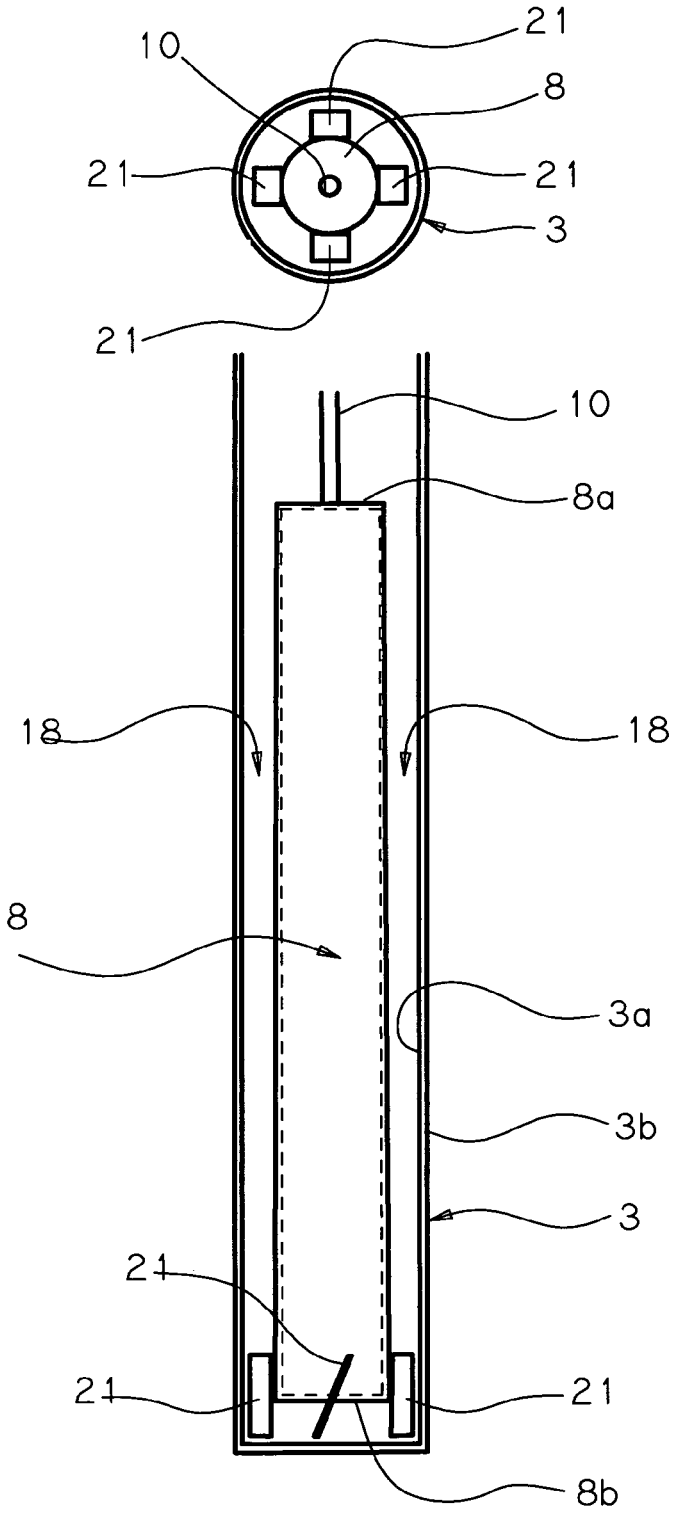
FIG. 3 shows a side elevation of a vertical cross-section through the housing and float of a descent apparatus according to a second preferred embodiment of the present invention.

FIG. 3 shows another embodiment of the descent device (1) with the float (8) provided with radially extending fins (21) that have planes inclined from vertical. The fins (21) are deflected by the liquid (12) during the descent or ascent and thereby cause rotation of the float (8) and therefore rotate the cap (9) and platform (6). This rotation provides another aspect of movement for the user.

Figure 4:
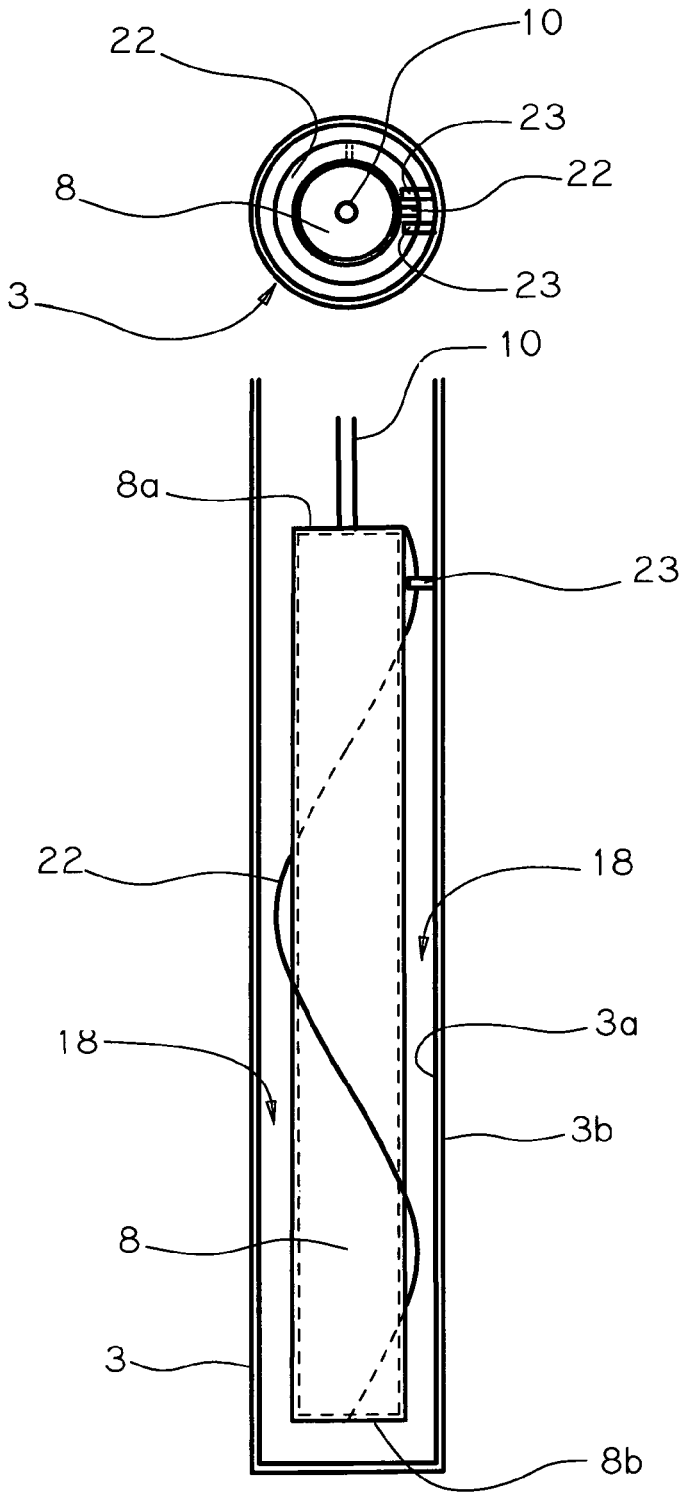
FIG. 4 shows a side elevation of a vertical cross-section through the housing and float of a descent apparatus according to a third preferred embodiment of the present invention.

FIG. 4 shows another embodiment that forces rotation of the float (8) and connected platform (6) by providing the float with a helical flange (22) that passes through a pair of locating guides (23) during descent/ascent. It should be appreciated that the reverse configuration is also possible, i.e. with the flange (22) provided on the housing inner surface (3*a*) and the locating guides (23) provided on the float (8).

Aspects of the present invention have been described by way of example only and it should be appreciated that modifications and additions may be made thereto without departing from the scope thereof.

What is claimed is:

1. A descent apparatus including a housing with a liquid conduit therethrough;

a buoyancy float constrained within the liquid conduit and capable of slidable movement along a first path between an upper and lower position;

a movable element located outside the liquid conduit and slidably coupled to the housing; and a non-magnetic mechanical connector, physically connecting the movable element to the buoyancy float, such that in use, the liquid conduit contains liquid and the position of the buoyancy float is variable by applying a force to the movable element, and wherein the slidable movement of the buoyancy float along the first path produces a corresponding movement of the movable element outside the housing along a second path co-axial, or parallel with the first path, and wherein the liquid conduit includes at least one liquid displacement passage permitting passage of liquid displaced from beneath or above the buoyancy float as a result of the buoyancy float's descent or ascent respectively and the liquid displacement passage's total cross-sectional area (transverse to liquid flow during the displacement) is smaller than the buoyancy float's cross-sectional area (transverse to the buoyancy float's movement in the liquid conduit) thereby providing a constriction to liquid flow.

2. A descent apparatus as claimed in claim 1, wherein the movable element is physically connected to the buoyancy float via one or more intermediate rigid members connected to the buoyancy float, the slidable movement of the movable element producing a corresponding movement in the one or more rigid members and the buoyancy float.

3. A descent apparatus as claimed in claim 2, wherein a said rigid member includes a duct in liquid communication with the liquid conduit.

4. A descent apparatus as claimed in claim 3, wherein a said rigid member and/or the duct includes a superhydrophobic surface.

5. A descent apparatus as claimed in claim 3, wherein the duct is open to atmosphere.

6. A descent apparatus as claimed in claim 1, wherein the liquid conduit and/or the housing includes an upper stop for inhibiting upwards movement of the buoyancy float and/or the movable element.

7. A descent apparatus as claimed in claim 6, wherein a buffer portion of the mechanical connector is engagable with the upper stop near a lower extent of the movable element slidable movement.

8. A descent apparatus as claimed in claim 7, wherein engagement of the buffer portion with the upper stop inhibits relative rotation of the movable element and the upper stop.

9. A descent apparatus as claimed in claim 6, wherein rotation of the movable element is inhibited by frictional contact between a portion of the buoyancy float and/or the mechanical connector and the upper stop.

10. A descent apparatus as claimed in claim 1, wherein rotation of the buoyancy float and/or the movable element relative to the liquid conduit is at least partially inhibited through at least a portion of the range of the slidable movement.

11. A descent apparatus as claimed in claim 10, wherein the portion of inhibited rotation includes a lower portion at or adjacent to a lower extent of the slidable movement.

12. A descent apparatus as claimed in claim 11, wherein rotation of the movable element through the lower portion is inhibited by frictional contact between a portion of the buoyancy float and/or the mechanical connector and a lower stop.

13. A descent apparatus as claimed in claim 10, wherein the portion of inhibited rotation includes an upper portion at or adjacent to an upper extent of the slidable movement.

14. A descent apparatus as claimed in claim 1, wherein the housing includes an elongated tube with an inner and an outer surface and wherein the slidable movable element is located about the outer surface with the buoyancy float located adjacent to the inner surface.

15. A descent apparatus as claimed in claim 14, wherein the inner surface also defines the liquid conduit.

16. A descent apparatus as claimed in claim 14, wherein the movable element includes an annular platform encircling the housing outer surface.

17. A descent apparatus as claimed in claim 1, wherein the liquid conduit and the buoyancy float have complimentary engaging projections configured to cause rotation of the float during the slidable movement.

18. A descent apparatus as claimed in claim 17, wherein the complimentary engaging projections include a helical flange and one or more locating guides.

19. A descent apparatus as claimed in claim 1, wherein in use, the buoyancy float is submerged in liquid throughout the range of the slidable movement along the first path.

20. A descent apparatus as claimed in claim 1, wherein the movable element includes a platform for supporting a person and/or other object during the slidable movement.

21. A descent apparatus as claimed in claim 1, wherein the movable element is also rotatable relative to the housing.

22. A descent apparatus as claimed in claim 1, wherein the mechanical connector is configured such that the movable element and the buoyancy float are maintained in a fixed spatial relationship with respect to each other to travel along respective first and second paths.

23. A descent apparatus as claimed in claim 1, wherein the buoyancy float is configured to move with the slidable movement of the movable element but not rotate with the mechanical connector and/or the movable element.

24. A descent apparatus as claimed in claim 1, wherein the movable element is formed as a continuous member with a portion formed as the mechanical connector extending into the liquid conduit to the buoyancy float.

25. A descent apparatus as claimed in claim 1, wherein in use the liquid conduit is open to the atmosphere.

26. A descent apparatus as claimed in claim 1, wherein the liquid conduit is substantially sealed to inhibit liquid egression.

27. A descent apparatus as claimed in claim 1, wherein the liquid displacement passage is formed between the buoyancy float and the liquid conduit.

28. A descent apparatus as claimed in claim 1, wherein the buoyancy float has an internal aperture passing therethrough, the aperture forming the liquid displacement passage.

29. A descent apparatus as claimed in claim 1, including at least one further liquid conduit located outside the confines of the liquid conduit, the at least one further liquid conduit forming the liquid displacement passage.

30. A descent apparatus as claimed in claim 1, wherein the buoyancy float includes one or more fins configured to cause rotation of the buoyancy float during the slidable movement.

31. An exercise apparatus including a descent apparatus as claimed in claim 1, wherein the movable element includes a user-engagement element configured such that a user can apply a force to the user-engagement element to move the movable element along the first path.

32. A descent apparatus as claimed in claim 1, including a single said buoyancy float, and/or a single said movable element and a single said liquid displacement passage.

33. A method of exercise using an exercise apparatus, the apparatus including:

a housing with a liquid conduit therethrough;

a buoyancy float constrained within the liquid conduit and capable of slidable movement along a first path between an upper and lower position;

a movable element located outside the liquid conduit and slidably coupled to the housing; and a non-magnetic mechanical connector, physically connecting the movable element to the buoyancy float, such that in use, the liquid conduit contains liquid and the position of the buoyancy float is variable by applying a force to the movable element, and the slidable movement of the buoyancy float along the first path produces a corresponding movement of the movable element outside the housing along a second path co-axial, or parallel with the first path, and the liquid conduit includes at least one liquid displacement passage permitting passage of liquid displaced from beneath or above the buoyancy float as a result of the buoyancy float's descent or ascent respectively and the liquid displacement passage's total cross-sectional area (transverse to liquid flow during the displacement) is smaller than the buoyancy float's cross-sectional area (transverse to the buoyancy float's movement in the liquid conduit) thereby providing a constriction to liquid flow, and the movable element includes a user-engagement element configured such that a user can apply a force to the user-engagement element to move the movable element along the first path, the method including:

engaging with the user-engagement element and applying a force to the user-engagement element to cause slidable movement of the movable element outside the housing along the second path and wherein the slidable movement of the movable element causes the buoyancy float to move along the first path thereby providing resistance to the applied force.

34. A method of operating a descent apparatus, the apparatus including a housing with a liquid conduit therethrough;

a buoyancy float constrained within the liquid conduit and capable of slidable movement along a first path between an upper and lower position;

a movable element located outside the liquid conduit and slidably coupled to the housing; and a non-magnetic connector, physically connecting the movable element to the buoyancy float, such that when in use, the liquid conduit contains liquid and the position of the buoyancy float is variable by applying a force to the movable element, and wherein the slidable movement of the buoyancy float along the first path produces a corresponding movement of the movable element outside the housing along a second path co-axial, or parallel with the first path, and wherein the liquid conduit includes at least one liquid displacement passage permitting passage of liquid displaced from beneath or above the buoyancy float as a result of the buoyancy float's descent or ascent respectively and the liquid displacement passage's total cross-sectional area (transverse to liquid flow during the displacement) is smaller than the buoyancy float's cross-sectional area (transverse to the buoyancy float's movement in the liquid conduit) thereby providing a constriction to liquid flow; and wherein the movable element includes a platform for supporting a person and/or other object during slidable movement;

the method including moving an object or person onto the platform to cause movement of the buoyancy float along a first path between the upper position and the lower position.

* * * * *